US006354866B1

(12) United States Patent
Hasegawa et al.

(10) Patent No.: US 6,354,866 B1
(45) Date of Patent: Mar. 12, 2002

(54) TERMINAL FITTING

(75) Inventors: Teruaki Hasegawa; Hideshi Tachi, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/739,957

(22) Filed: Dec. 20, 2000

(30) Foreign Application Priority Data

Jan. 11, 2000 (JP) ..... 2000-002861

(51) Int. Cl.[7] ..... H01R 4/24
(52) U.S. Cl. ..... 439/422; 439/424
(58) Field of Search ..... 439/421–424, 439/395

(56) References Cited

U.S. PATENT DOCUMENTS 3,728,473 A * 4/1973 Kuo
3,997,233 A * 12/1976 Evans
4,832,620 A * 5/1989 Yamamoto ..... 439/422
4,834,673 A * 5/1989 Beinhaur et al. ..... 439/422

FOREIGN PATENT DOCUMENTS

DE 199 04 277 8/1989
EP 0 286 422 10/1988
EP 0365376 A1 * 9/1989
GB 2 244 871 12/1991
JP 4-359874 12/1992

* cited by examiner

*Primary Examiner*—Khiem Nguyen
(74) *Attorney, Agent, or Firm*—Banner & Witcoff, Ltd.

(57) ABSTRACT

Connecting members 28F and 28R pierce conductors 11 in a state whereby plate faces of these connecting members 28F and 28R are approximately at a right angle with respect to the length-wise direction of the conductors 11. Consequently, if a pulling force is exerted on flat cables 10A and 10B along the length-wise direction of the conductors 11, the connecting members 28F and 28R will not cause edges of slit-shaped piercing locations 35 to split. The piercing locations 35 of the connecting members 28F and 28R (locations where the rigidity has decreased due to their having been pierced) are provided along the length-wise direction of the conductors 11 in a location that is clamped between the connecting members 28F and 28R and a base 22 (the rigidity of these locations does not decrease due to piercing). As a result, if a bending force is exerted on the flat cables 10A and 10B this bending force is absorbed at the clamping locations, and does not reach the piercing locations 35. Consequently, bending at the piercing locations 35 is prevented.

10 Claims, 3 Drawing Sheets

TERMINAL FITTING

TECHNICAL FIELD

The present invention relates to a terminal fitting for a flat electrical cable.

BACKGROUND OF THE INVENTION

One example of a conventional terminal fitting is described in JP 4-359874, and is connected to a flat cable having a long and narrow plate-like conductor sandwiched between insulating layers.

This terminal fitting is provided with a plate-like base and plate-like connecting members that protrude upwards at a right angle from both side edges of the base. The base is attached to one side of the flat cable, and the connecting members are joined to the conductor, the connecting members being bent in an approximate arc shape, and tips of these bent portions piercing an outer insulating layer of the flat cable.

The terminal fitting can be used as a means to join two flat cables, whereby the two flat cables are positioned overlapping one another in the length direction of the conductor, the terminal fitting being attached by piercing connecting portions of the terminal fitting through the overlapping portions.

At this juncture, if the plate faces of the connecting members are positioned so as to be parallel to the length-wise direction of the conductor, a pulling force exerted along the length-wise direction of the conductor located between the two flat cables may cause the connecting members, which pierce the flat cables, to function like a blade, splitting these flat cables along edges of slits that are created by the piercing.

It was considered that this problem might be dealt with by piercing the conductor so that the direction of the plate faces of the connecting members is approximately at a right angle with respect to the length-wise direction of the conductor. In that case, however, when a bending force is exerted on the flat cable, the portions along the area pierced by the connecting members are bent up.

The present invention has taken the above problem into consideration, and aims to present a terminal fitting wherein flat cables are not damaged by pulling forces or bending forces.

SUMMARY OF THE INVENTION

According to the invention there is provided a one-piece terminal fitting formed from sheet metal and adapted to electrically connect a plurality of overlying flat cables each having a strip-like conductor and an insulating cover, said terminal fitting comprising:

a base engageable with one side of the flat cables, connecting portions protruding from said base and having edges adapted to pierce the flat cables and to project from the other side of the flat cables, wherein said connecting portions are bendable in a direction transverse to the length of the strip and substantially at a right angle to extend over and contact said other side, whereby the flat cables can be tightly engaged between said base and said connecting portions.

Such a terminal fitting prevents cable splitting, and is adapted to relieve the pierced portions of bending stresses.

Preferably the fitting further comprises clamping portions protruding from said base, each said clamping portion having an edge adapted to piece the flat cables from said one side and to project from said other side, wherein each said clamping portion is bendable substantially at a right angle to extend over and tightly engage the exposed surface of said connecting portion whereby said connecting portion and flat cable can be tightly engaged between said base and said clamping portions.

In a preferred embodiment, the fitting comprises a flat blank having an elongate body, a first arm extending laterally from one long side of said body adjacent one end thereof and extending parallel to said body in a first direction at a distance therefrom, a second arm extending laterally from the other long side of said body adjacent the other end thereof, and extending parallel to said body at a distance therefrom and in a direction opposite to said first direction, two laterally and oppositely extending third arms at one end of said body, two laterally and oppositely extending third arms at the other end of said body, and two longitudinally extending fourth arms one at each end of said body, said first, second and third arms having pointed ends, and the ends of said first and second arms being spaced from adjacent third arms.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENTS

An embodiment of the present invention is described below with the aid of FIGS. 1 to 7.

In the following description FIGS. 1, 2, 4, 5 and 7 are in an anterior-posterior direction, and the left side is considered to be the anterior. FIGS. 2, 3, 5 and 6 take the up-down direction as the norm. Moreover, the upper side is also designated as the outer side and the lower side as the inner side.

Figure 1:
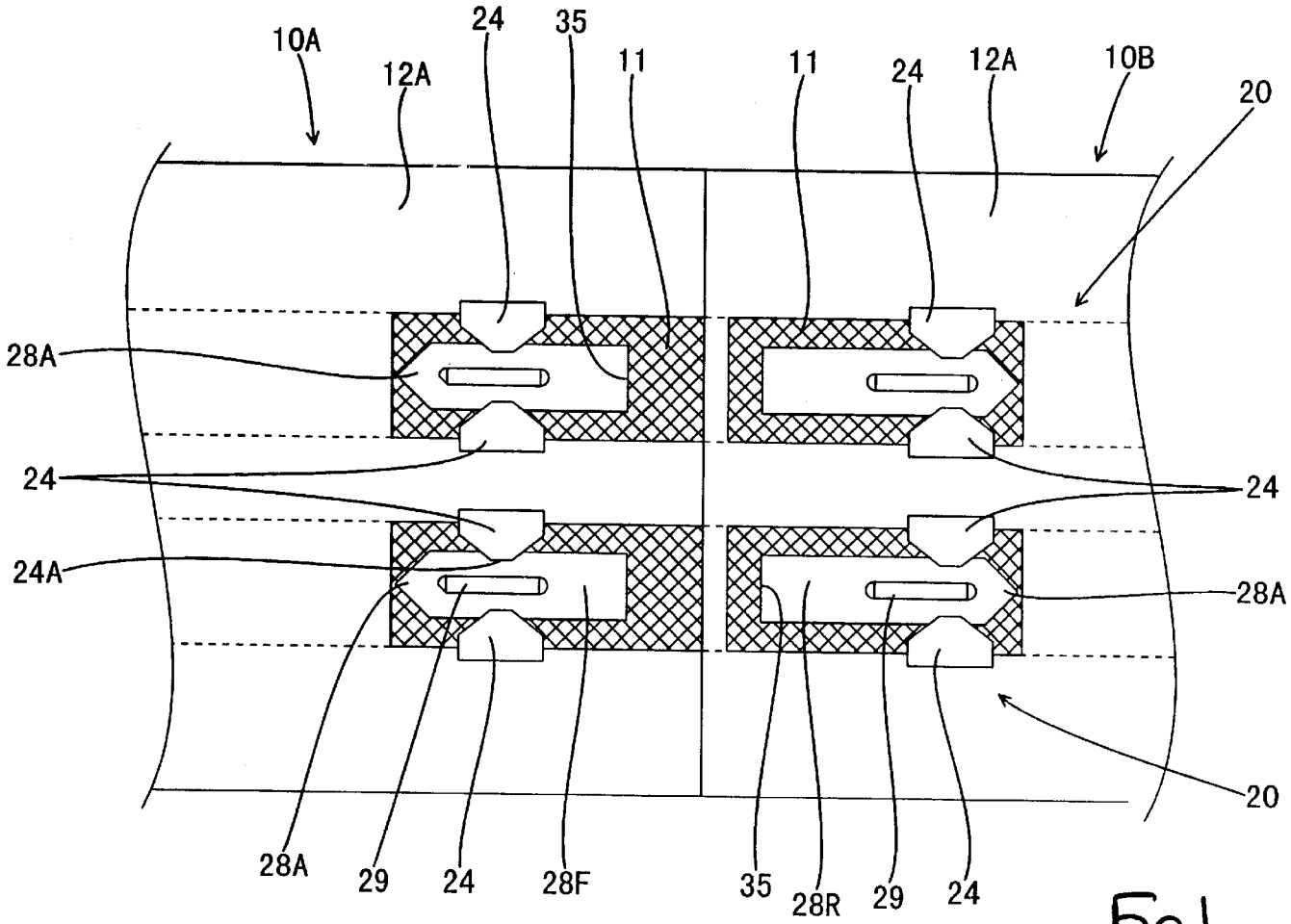
FIG. 1 is a plan view of an embodiment of the invention showing terminal fittings in a state whereby they have been attached to flat cables.
Figure 2:
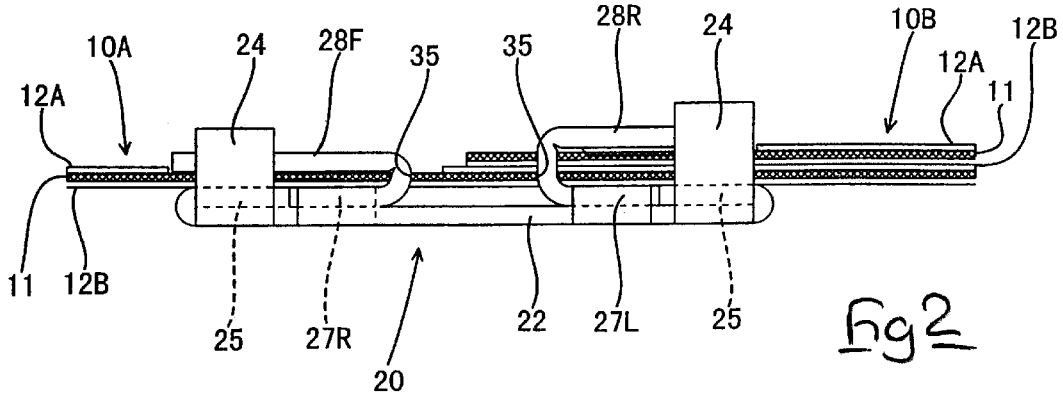
FIG. 2 is a left face view of FIG. 1.
Figure 6:
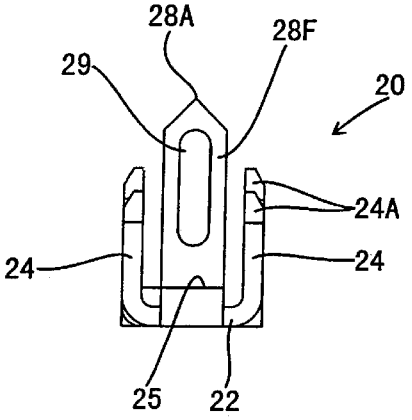
FIG. 6 is a front view of one terminal fitting.

Flat cables 10A and 10B will be described first. Each flat cable 10A and 10B is formed from a plurality of conductors 11, these having a long and narrow thin plate shape and being provided in a mutually parallel manner, and a pair of insulating sheets 12A and 12B that sandwiches these conductors 11 from above and below. There is a main flat cable 10A and a second flat cable 10B. An anterior end of the second flat cable 10B overlaps with the main flat cable 10A, this second flat cable 10B overlapping therewith from above, at a location part-way along the flat cable 10A (FIG. 2). The overlapping portions of the flat cables 10A and 10B are joined together by terminal fittings 20, and these terminal fittings 20 join the conductors 11 that face one another above and below.

The portions of the conductors 11 that are joined by the terminal fittings 20 are cut away as follows: the insulating sheet 12A covering an upper face side of the lower main flat cable 10A is cut away in a square hole shape, so as to expose only the conductors 11, along an area slightly in front of an anterior end of the upper second flat cable 10B. The insulating sheet 12A covering an upper face side of the upper second flat cable 10B is cut away in a square hole shape, so as to expose only the conductors 11, along an area slightly behind its anterior end. That is, seen from above, the main conductors 11 and the second conductors 11 are exposed in a manner whereby they are aligned in a length-wise direction, with a small space remaining therebetween.

Figure 7:
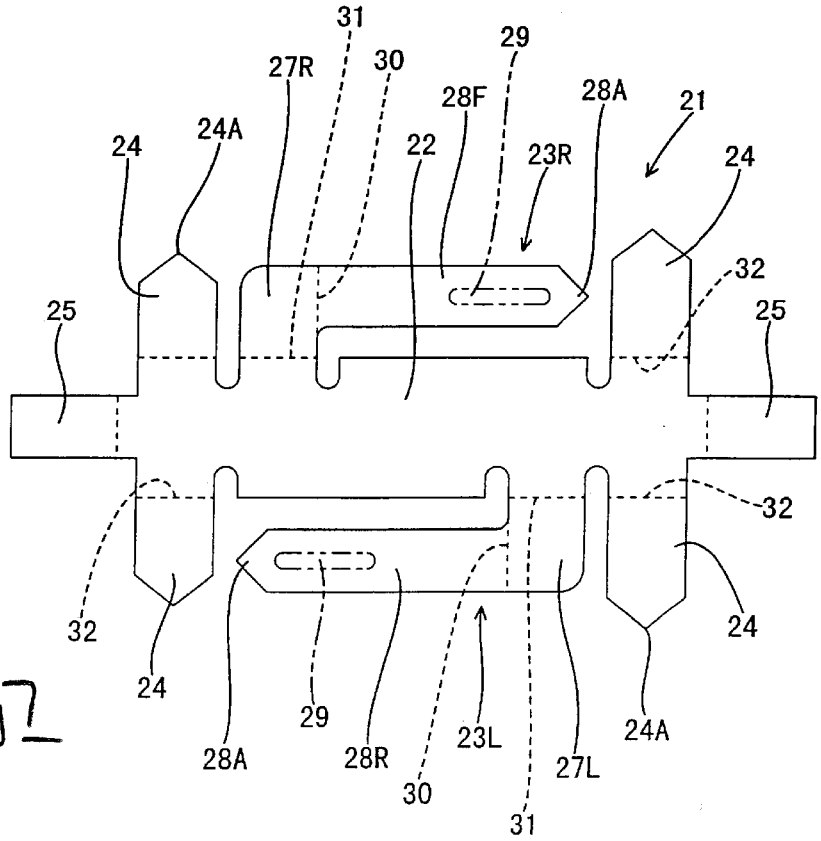
FIG. 7 is a plan view showing one terminal fitting in an opened-out state to being bent.
Figure 3:
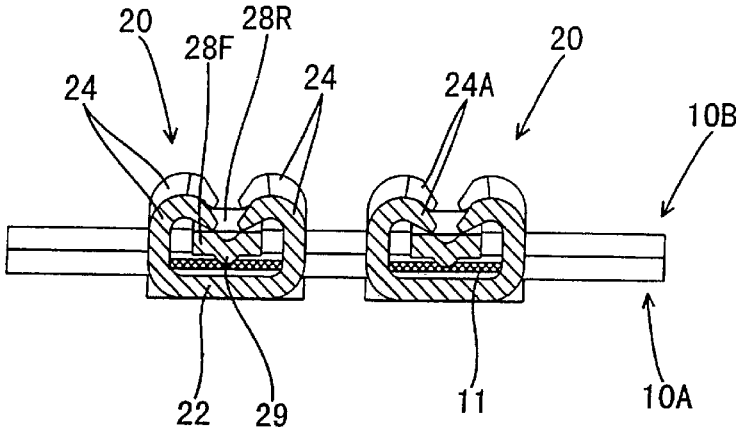
FIG. 3 is a cross-sectional view of the terminal fittings in the state whereby they have been attached to the flat cables.
Figure 4:
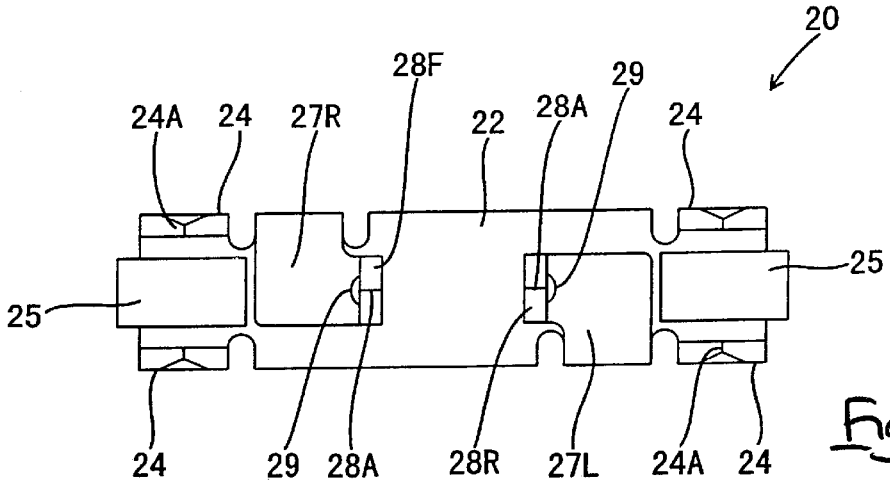
FIG. 4 is a plan view of one terminal fitting.
Figure 5:
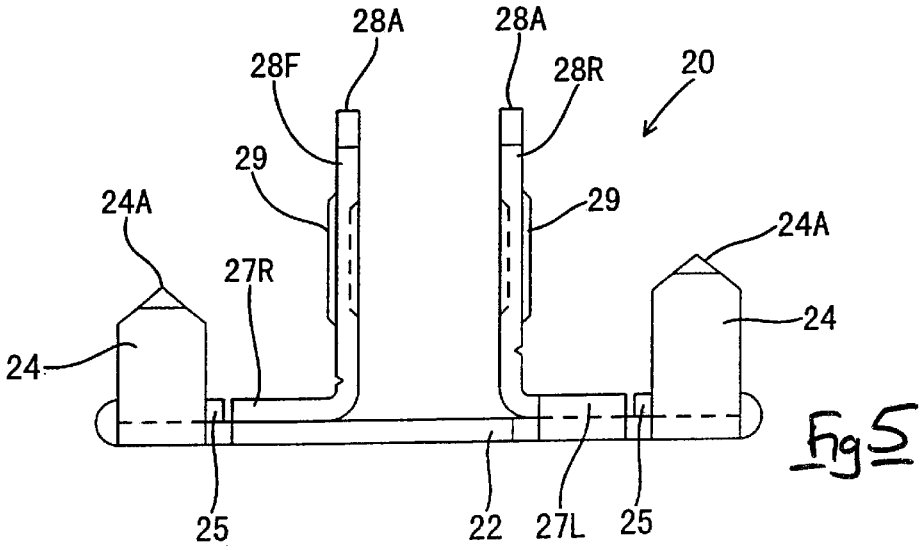
FIG. 5 is a left face view of one terminal fitting.

Each terminal fitting 20 is formed by pressing and embossing terminal fitting material 21, this comprising a flat conductive metal plate that has been punched into a specified shape (shown in FIG. 7). The terminal fitting material 21 has a rectangular base 22 that extends in an anterior-posterior direction (the same direction as the length-wise direction of the conductors 11); a pair of left and right extending members 23L and 23R that extend in an L-Shape from left and right side edges of the base 22, these forming a unified face therewith; four regulating members 24 that extend outwards at approximately a right angle from left and right side edges at anterior and posterior ends of the base 22, these regulating members 24 forming a unified face therewith and extending ends thereof forming triangular piercing members 24A; and a pair of rising members 25 that extend to the anterior and posterior, from the anterior and posterior ends respectively, of the base 22, these forming a unified face therewith.

The extending members 23L and 23R are described next. The right extending member 23R (at the top of FIG. 7), is provided at a location towards the anterior of the base 22 and is formed from an approximately square base member 27R and a connecting member 28F. The base member 27R protrudes to the right from a location slightly behind the anteriorly-located regulating member 24. The connecting member 28F is long and narrow and extends towards the posterior from a posterior edge side of the base member 27R along the right side edge of the base 22. The left extending member 23L is provided somewhat to the posterior of the base 22 and is symmetrical to the right extending member 23R along the centre of the base 22 (the symmetry is relative to the anterior-posterior and left-right directions thereof). The left extending member 23L is formed from a square base member 27L and a connecting member 28R. The approximately square base member 27L protrudes to the left from a location slightly before the posteriorly-located regulating member 24. The connecting member 28R is long and narrow and extends towards the anterior from an anterior edge side of the base member 27L along the left side edge of the base 22. Tips of the extending ends of both connecting members form triangular piercing members 28A.

When the terminal fittings 20 are moulded, strengthening members 29 are formed by embossing the connecting members 28F and 28R as illustrated. These strengthening members 29 extend along the length direction of the connecting members 28F and 28R and protrude towards a lower face side (the side making contact with upper faces of the flat cables 10A and 10B when the terminal fittings 20 are in an attached state therewith) when the terminal fittings 20 are in an opened-out state. Next, the extending members 23L and 23R, the regulating members 24, and the rising members 25 are each bent.

The extending members 23L and 23R are bent as follows: the connecting members 28F and 28R are first bent downwards at a right angle along borders 30 between these members, then the base members 27L and 27R are bent towards the upper face side of the base 22 along folding lines 31 that extend along side edges of this base 22. As a result, the connecting members 28F and 28R are at a location that is approximately central relative to the left-right direction of the base 22, and protrude upwards at a right angle from this base 22 at two locations relative to the anterior-posterior direction thereof, (the length-wise direction of the conductors 11) with a space remaining therebetween. Plate faces of these two connecting members 28F and 28R face to the left and the right (in a direction perpendicular to the length direction of the conductors 11).

When the terminal fittings 20 are to be attached to the flat cables 10A and 10B, the connecting members 28F and 28R are in a state whereby they can be bent so as to be inverted in the direction opposing the corresponding connecting members 28R and 28F (that is, the anterior connecting member 28F can be bent to the anterior, the posterior connecting member 29R can be bent to the posterior). This bending direction results in the strengthening members 29 coming into contact with the upper faces of the flat cables 10A and 10B. The piercing members 28A at the upper ends of the connecting members 28F and 28R protrude upwards in a sharp manner awaiting attachment to the flat cables 10A and 10B.

The regulating members 24 are bent upwards at a right angle (in the same direction as the connecting members 28F and 28R) along folding members 32 that extend along side edges of the base 22. When the terminal fittings 20 are to be attached to the flat cables 10A and 10B, these regulating members 24 can be bent at a right angle so as to be inverted over the upper face side of the base 22. The piercing members 24A at the upper ends of the regulating members 24 protrude upwards in a sharp manner awaiting attachment to the flat cables 10A and 10B.

The rising members 25 are bent so as to be inverted over the base 22, fitting tightly with the upper face thereof. Upper faces of the rising members 25 are at approximately the same height as upper faces of the base members 27L and 27R, and the rising members are positioned so as to be adjacent to the base members 27L and 27R in the anterior-posterior direction. The rising members 25 and the base members 27L and 27R correspond with the connecting members 28F and 28R that are bent so as to be inverted over the upper faces of the flat cables 10A and 10B.

Next, the attachment of the terminal fittings 20 to the flat cables 10A and 10B will be described.

The second flat cable 10B is positioned so as to overlap the main flat cable 10A from above, maintaining the conductors 11 in a state whereby their position is fixed. The terminal fittings 20 are attached to these flat cables 10A and 10B from below (from the inner side). At this juncture, the anterior connecting member 28F pierces the conductors 11 of the main flat cable 10A, and the posterior connecting member 28R pierces the conductors 11 of the main flat cable 10A and the second flat cable 10B. The regulating members 24 pierce at the side edges of the conductors 11. The connecting members 28F and 28R and the regulating members 24 have pointed piercing members 28A and 24A formed at their upper ends. Consequently, they can pierce the flat cables 10A and 10B without causing them to move excessively.

After the connecting members 28F and 28R and the regulating members 24 have pierced the cables 10, the rising members 25 and the base member 27L and 27R that overlap the upper face of the base 22 are in a state whereby they make contact with the inner face (the lower face) of the lower main end flat cable 10A. The upwardly rising piercing portions of the connecting members 28F and 28R are then bent. The anterior connecting member 28F is bent towards the anterior and the posterior connecting member 28R is bent towards the posterior. The bent connecting members 28F and 28R press tightly against the upper faces of the conductors 11 exposed at the upper faces of the flat cables 10A and 10B. These connecting members 28F and 28R remain plate-shaped, and consequently fit tightly along a wide area of the upper faces of the conductors 11. By this means, the flat cables 10A and 10B are gripped between the base members 27L and 27R, the rising members 25, the connecting members 28F and 28R, and the base 22. As a result, the terminal fittings 20 are attached in a conductive manner to the flat cables 10A and 10B in a state whereby movement therebetween is prevented.

Next, the regulating members 24 are bent into an arc shape and are crimped inwards, tips of these regulating members 24 pressing tightly against upper faces of the connecting members 28F and 28R. Since the regulating members 24 press the connecting members 28F and 28R from above, these connecting members 28F and 28R are prevented from moving away from the upper faces of the flat cables 10A and 10B. By this means, the flat cables 10A and 10B are reliably gripped between the base 22 and the connecting members 28F and 28R. In this manner, the terminal fittings 20 join the conductors 11 of the main flat cable 10A with the conductors 11 of the second flat cable 10B.

When the terminal fittings 20 are in an attached state with the flat cables 10A and 10B, the connecting members 28F and 28R pierce the conductors 11 in a state whereby the plate faces thereof are approximately at a right angle to the length-wise direction of the conductors 11. Consequently, if a pulling force is exerted on the flat cables 10A and 10B in the direction of the length-wise direction of the conductors 11, the connecting members 28F and 28R will not cause edges of slit-shaped piercing locations 35 to split.

Furthermore, the piercing locations 35 (locations whereby the rigidity has decreased due to having been pierced) of the connecting members 28F and 28R are located along the length-wise direction of the conductors 11 in locations where they are gripped between a strong area (that is, locations where the rigidity has not been decreased due to piercing) of the connecting members 28F and 28R and the base 22. As a result, if a bending force is exerted on the flat cables 10A and 10B so as to bend both ends of the terminal fittings 20 upwards, this bending force will be absorbed by this area (that is, the area where the connecting members 28F and 28R make contact with the conductors 11), and will not affect the pierced locations. That is, the flat cables 10A and 10B will not bend upwards along the entire length of the terminal fittings 20 in the anterior-posterior direction thereof. Consequently, the flat cables 10A and 10B are prevented from bending at the piercing locations 35. Furthermore, the presence of the base 22 prevents the flat cables 10A and 10B from bending downwards.

The connecting members 28F and 28R remain plate-shaped as they press the flat cables 10A and 10B. Consequently, these flat cables 10A and 10B are gripped along a wide area between the base 22 and the connecting members 28F and 28R. As a result, a pulling force exerted on the flat cables 10A and 10B will not affect the piercing locations 35 of the connecting members 28F and 28R. Furthermore, the connecting members 28F and 28R and the conductors 11 make contact along a wide area. Consequently, this contact is extremely reliable.

Since the connecting members 28F and 28R are pressed by the regulating members 24, they are prevented from moving away from the flat cables 10A and 10B. As a result, these flat cables 10A and 10B are gripped reliably.

The strengthening members 29 formed on the connecting members 28F and 28R make contact with the upper faces of the conductors 11, thereby causing these upper faces to become concave in shape. Consequently, the pushing force thereon is strong. Moreover, the connecting members 28F and 28R and the conductors 11 are prevented from moving to the left or right relative to one another.

The connecting members 28F and 28R are formed by bending the extending members 23L and 23R that protrude outwards from the side edges of the base 22. The connecting members are not formed by cutting out portions of the base. As a result, the strength of the base 22 is not diminished.

When the terminal fitting material 21 is in an opened-out state, the extending members 23L and 23R that are used to form the connecting members 28F and 28R extend in an L-shape along the side edges of the base 22. Consequently, the extending members 23L and 23R can be provided along the outer sides of the base 22 with minimum wastage of materials.

The present invention is not limited to the embodiments described above with the aid of figures. For example, the possibilities described below also lie within the technical range of the present invention. In addition, the present invention may be embodied in various other ways without deviating from the scope thereof. (1) In the embodiment described above, the extending members protrude from the outer edges of the base, and the connecting members are formed by bending the extending members inwards and then upwards. However, according to the present invention, the connecting members may be formed by cutting out portions of the base. (2) In the embodiment described above, the portions of the connecting members that have pierced the conductors press completely against the flat cables while retaining their plate shape. However, according to the present invention, only a part of the bent piercing portions may press against the flat cables. (3) In the embodiment described above, the extending members that form the connecting members extend from the side edges (the edges extending along the length-wise direction of the conductors) of the base in an L-shape. However, according to the present invention, I-shaped extending members may extend from both ends (corresponding to the ends relative to the length-wise direction of the conductors) of the base, and these may be bent to form the connecting members.

What is claimed is:

1. A one-piece terminal fitting formed from sheet metal and adapted to electrically connect a plurality of flat cables each having a strip-like conductor and an insulating cover, said terminal fitting comprising:

a base overlapping each flat cable and engageable with at least one side of one of the flat cables, connecting portions protruding from a central portion of said base, each said connecting portion having an edge adapted to pierce at least one of the flat cables and to project from the other side thereof, wherein said connecting portions are bendable away from each other in opposite directions to substantially extend over and contact a conductor such that each connecting portion contacts a conductor of a different flat cable, and clamping portions protruding from said base, each said clamping portion having an edge adapted to pierce at least one of the flat cables and to project from the other side thereof, wherein each said clamping portion is bendable transversely over one of the connecting portions whereby the flat cables can be tightly engaged between said base and said connecting portions.

2. A terminal fitting according to claim 1 wherein said clamping portions are bendable in a direction transverse to the bending direction of said connecting portions.

3. A terminal fitting according to claim 1 and having two of said connecting portions bendable in opposite directions.

4. A terminal fitting according to claim 1 and having two clamping portions for association with each of said connecting portions.

5. A terminal fitting according to claim 4 wherein two clamping portions associated with a respective connecting portion are bendable in opposite directions.

6. A terminal fitting according to claim 1 wherein said connecting portions each have an indentation adapted for contact with said other side.

7. A terminal fitting according to claim 6 wherein said indentation is linear and extends along the mid-line of the respective connecting portion in the length direction thereof.

8. A one-piece terminal fitting formed from sheet metal and adapted to electrically connect a plurality of flat cables each having a strip-like conductor and an insulating cover, said terminal fitting comprising:

a base engageable with one side of the flat cables;

connecting portions protruding from said base and having edges adapted to pierce the flat cables and to project from the other side of the flat cables, wherein said connecting portions are bendable to substantially extend over and contact said other side, whereby the flat cables can be tightly engaged between said base and said connecting portions; and a flat blank having an elongate body, a first arm extending laterally from one long side of said body adjacent one end thereof and extending parallel to said body in a first direction at a distance therefrom, a second arm extending laterally from the other long side of said body adjacent the other end thereof, and extending parallel to said body at a distance therefrom and in a direction opposite to said first direction, two laterally and oppositely extending third arms at one end of said body, two laterally and oppositely extending third arms at the other end of said body, and two longitudinally extending fourth arms one at each end of said body, said first, second and third arms having pointed ends, and the ends of said first and second arms being spaced from adjacent third arms.

9. A terminal fitting according to claim 1 in combination with a plurality of overlying flat cables, said connecting portions piercing said cables and being bent over to contact one side of said cables, said clamping portions being bent over to contact the exposed surface of respective connecting portions thereby to tightly engage said cables.

10. A one-piece terminal fitting formed from sheet metal to electrically connect a plurality of flat cables each having a strip-like conductor and an insulating cover, said terminal fitting comprising:

a base overlapping each flat cable and engaged against at least one side of one of the flat cables, a pair of connecting portions protruding from said base, each said connecting portion having an edge to pierce entirely through at least one of the flat cables, wherein said connecting portions are bent to extend over and contact conductors of different flat cables and to grip at least one of the flat cables between the base and each connecting portion, and clamping portions protruding from said base, each said clamping portion having an edge to pierce entirely through at least one of the flat cables, wherein each said clamping portion is bent transversely over one of the connecting portions to tightly engage the flat cables between said base and said connecting portions.

* * * * *